US005979667A

United States Patent [19]

Earl

[11] Patent Number: 5,979,667

[45] Date of Patent: Nov. 9, 1999

[54] SORTING SYSTEM INCLUDING AN IMPROVED REJECT MECHANISM

[76] Inventor: Wayne Earl, 110 Farm Rd., Woodside, Calif. 94062

[21] Appl. No.: 08/878,473

[22] Filed: Jun. 18, 1997

[51] Int. Cl.[6] ..... B07C 9/00; F15B 15/17

[52] U.S. Cl. ..... 209/657; 92/51; 92/110

[58] Field of Search ..... 209/576, 577, 209/580, 587, 656, 657; 92/51, 107, 110

[56] References Cited

U.S. PATENT DOCUMENTS

| | | | |
|---|---|---|---|
| 3,910,701 | 10/1975 | Henderson et al. | 356/39 |
| 4,095,696 | 6/1978 | Sherwood | 209/75 |
| 4,120,402 | 10/1978 | Swanson | 209/75 |
| 4,131,540 | 12/1978 | Husome et al. | 209/582 |
| 4,134,498 | 1/1979 | Jones et al. | 209/564 |
| 4,204,950 | 5/1980 | Burford, Jr. | 209/558 |
| 4,225,242 | 9/1980 | Lane | 356/407 |
| 4,281,933 | 8/1981 | Houston et al. | 356/425 |
| 4,369,886 | 1/1983 | Lane et al. | 209/564 |
| 4,558,786 | 12/1985 | Lane | 209/558 |
| 4,750,408 | 6/1988 | Stoll | 92/51 |
| 5,197,607 | 3/1993 | Hakansson | 209/657 X |
| 5,279,426 | 1/1994 | Crismon et al. | 209/657 |

FOREIGN PATENT DOCUMENTS

| | | | |
|---|---|---|---|
| 2354439 | 12/1974 | Germany | 209/657 |

*Primary Examiner*—Tuan N. Nguyen

*Attorney, Agent, or Firm*—Flehr Hohbach Test Albritton & Herbert LLP

[57] ABSTRACT

A sorting mechanism for use in apparatus for sorting debris, unripe and ripe comestibles including a paddle and a drive cylinder for moving a bearing supported shaft which drives the paddle and a skirt for protecting the bearing.

2 Claims, 2 Drawing Sheets

SORTING SYSTEM INCLUDING AN IMPROVED REJECT MECHANISM

BRIEF DESCRIPTION OF THE INVENTION

This invention relates generally to a sorting system for separating inorganic materials such as dirt and debris, unripe comestibles, and ripe comestibles such as tomatoes, during a mechanical harvesting operation, and more particularly to a reject mechanism for striking the inorganic materials or comestibles to separate one from another.

BACKGROUND OF THE INVENTION

Sorting systems employing electronic sorters which are responsive to light of different frequencies reflected by the material to be sorted are well known. Typical systems are described in Swanson U.S. Pat. No. 4,120,412, and Lane et al. U.S. Pat. No. 4,369,886, among others. Systems of this type find particular application in tomato harvesters. The harvester is driven through tomato fields and picks up the vines and delivers the vines onto a conveyor. The harvester may also pick up inorganic materials such as dirt and debris. Some tomatoes fall off the vines during this process. The vines with attached tomatoes are delivered to a shaker which shakes off all tomatoes, ripe and unripe, and delivers them to one or more receiving conveyor belts arranged in parallel rows. The tomatoes fall from the receiving conveyor belts onto output conveyer belts which transport the tomatoes to an elevator for loading onto a truck for delivery.

The sorting system views the stream of tomatoes and debris as it falls from the receiving conveyor onto the output conveyer. The falling stream is illuminated with light of selected frequencies, and the reflected light is analyzed to identify debris and unripe tomatoes and activates a reject mechanism. The reject mechanism includes a paddle which strikes the debris and unripe tomatoes and causes them to be ejected from the stream to fall onto the ground. A similar sorting system may be used to reclaim ripe tomatoes from the mixed stream of tomatoes and dirt falling as the vines are transferred to the shaker. In this application the "reject" paddle is used to return the ripe tomatoes to the harvester while unwanted inorganic material and green tomatoes fall onto the ground.

In present day reject systems used in tomato sorters, the paddle is driven by a reject cylinder which includes a piston shaft assembly supported by a seal and bearing. The shaft drives a paddle which strikes the tomatoes and/or debris. Juices from the tomatoes and dirt and dust from the field accumulate on the shaft. As the shaft moves back and forth the dirt and juices destroy the bearing requiring frequent replacement of the reject mechanism. This not only involves the cost of the replacement parts and replacement labor, but more importantly results in down time for the harvesting equipment.

Sorting systems employing electronic sorters can be used with other comestible harvesters, in packing sheds and processing plants.

OBJECTS AND SUMMARY OF THE INVENTION

It is an object of the present invention to provide a sorting system which includes a reject mechanism which is relatively immune from the effects of juices, dirt and dust encountered during comestible sorting operations.

It is another object of the present invention to provide a reject mechanism which is relatively immune from juices, dirt and dust encountered in field harvesting and other comestible handling.

It is a further object of the present invention to provide a reject mechanism in which the drive shaft and drive shaft bearing are protected from the surrounds.

The sorting system of the present invention inspects a stream of comestibles such as tomatoes, and identifies ripe tomatoes, unripe tomatoes and debris. A reject paddle selectively strikes the identified comestibles and debris to separate or sort them from the main stream passing through the sorting system. A reject cylinder which includes a bearing supported piston/shaft assembly drives the paddle. A skirt which moves with the shaft is mounted on the shaft to protect the shaft and bearing from the surrounds.

BRIEF DESCRIPTION OF THE DRAWINGS

The foregoing and other objects of the present invention will be more clearly understood from the following description when read in conjunction with the drawings in which.

DESCRIPTION OF THE PREFERRED EMBODIMENT

The system will be described in the context of a tomato sorter. It will be apparent to those skilled in the art that the invention may be useful for the sorting of other comestibles, not only in harvesting operation but also in processing plants and packing sheds.

The invention is described in connection with a tomato harvester.

Figure 1:
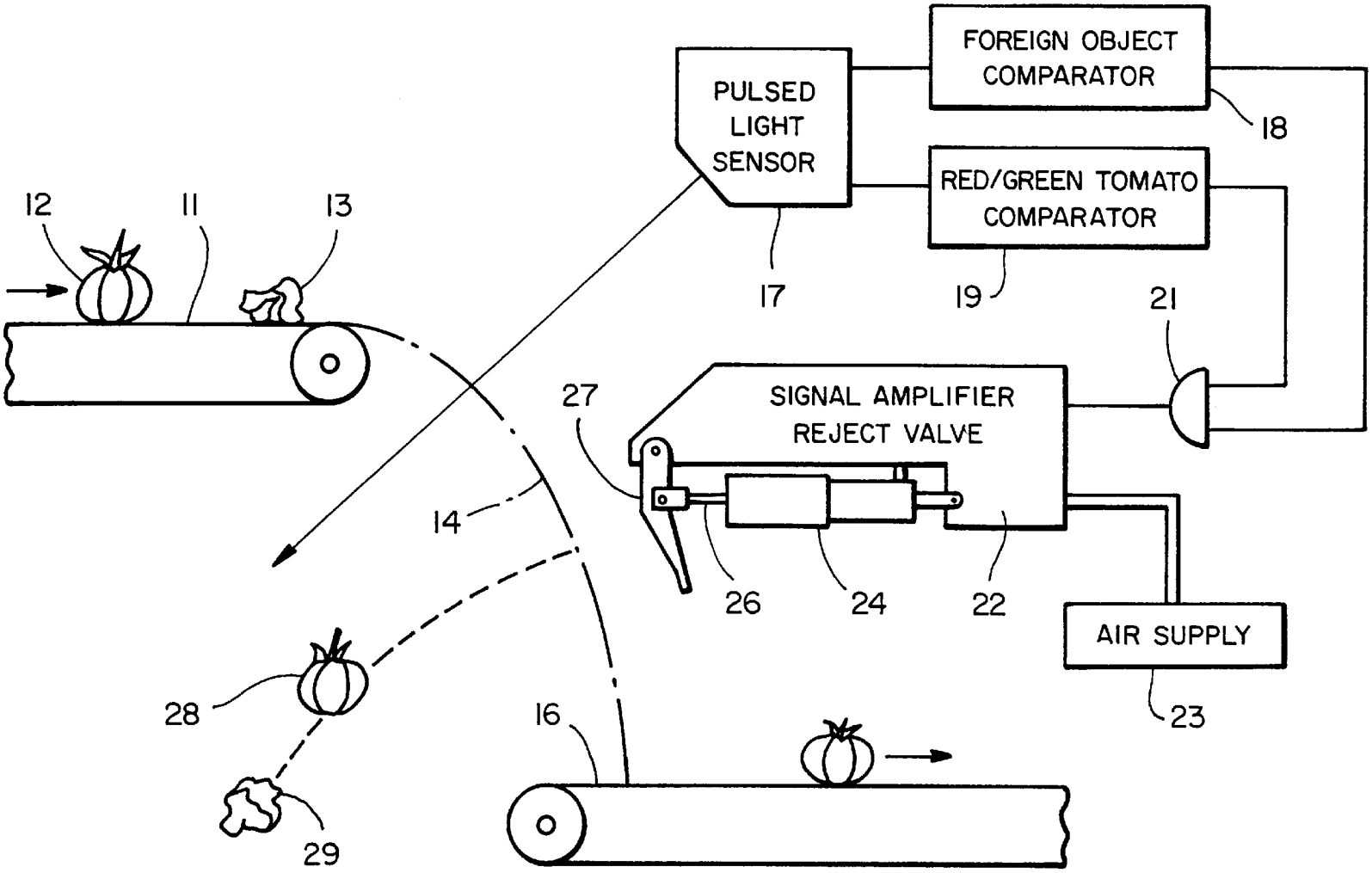
FIG. 1 schematically shows a sorting system incorporating the present invention.

The Referring to FIG. 1, a feeding conveyor belt 11 receives tomatoes 12 and debris 13 from the harvesting equipment. Only one belt is shown. However, a typical harvester will include a number of parallel belts. The tomatoes and debris fall from the belt 11 in a stream along the trajectory 14 onto an output conveyor 16 which transports the tomatoes 12 to an elevator (not shown) for loading onto a truck. The sorter includes an optical system 17 which directs pulsed light of selected frequencies to the path 14. The light is reflected by passing tomatoes and debris and sensed or detected. The output from the detector is applied to comparators 18 and 19. Each comparator compares the amplitude of the reflected light at two frequencies and develops a reject signal when the light reflected at the two frequencies does not have a predetermined relationship. The frequencies for the light are selected so that there is a large difference between the light reflected by ripe tomatoes and unripe tomatoes, and the light reflected by dirt, debris and ripe tomatoes. Thus, one comparator 19 compares reflected light from a ripe tomato with that from a green, unripe tomato. The other, comparator 18, compares the reflected light from a ripe tomato with light reflected by debris. The comparators independently generate sort signals.

The sort signals from the comparators 18 and 19 are applied to an "or" gate 21, then amplified to activate a reject valve 22. The reject valve applies pressurized air from the air supply 23 to the reject cylinder assembly 24. This drives the shaft 26 which rotates the paddle 27 to strike the unripe tomato 28 and debris 29 to eject or sort them from the stream while allowing acceptable ripe tomatoes to fall onto the output belt 16.

In another example the sorting system is used to separate dirt from tomatoes that falls off the vines prior to the shaking system. In this instance the paddle serves to deflect tomatoes into the harvester while allowing the dirt and debris to fall to the ground.

Figure 2:
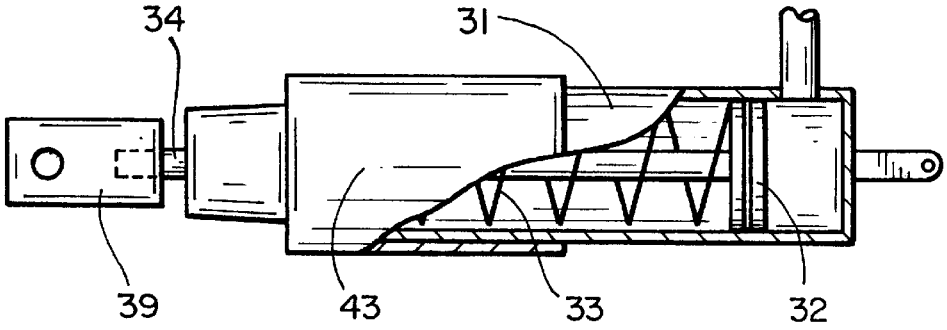
FIG. 2 is an elevational view, partly in section, of a reject cylinder incorporating the present invention.
Figure 3:
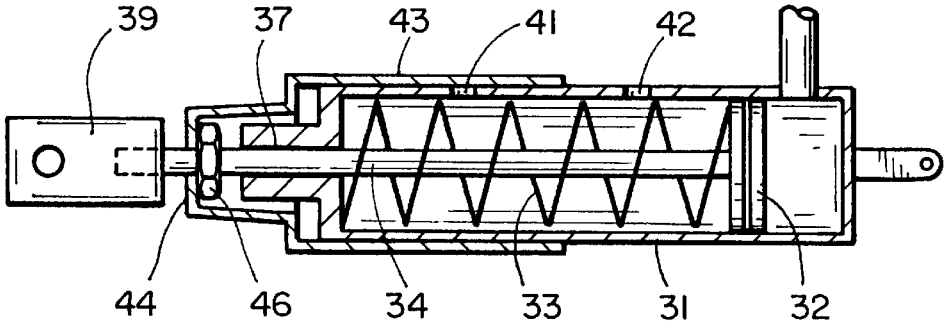
FIG. 3 is a sectional view of the reject cylinder shown in FIG. 2.
Figure 4:
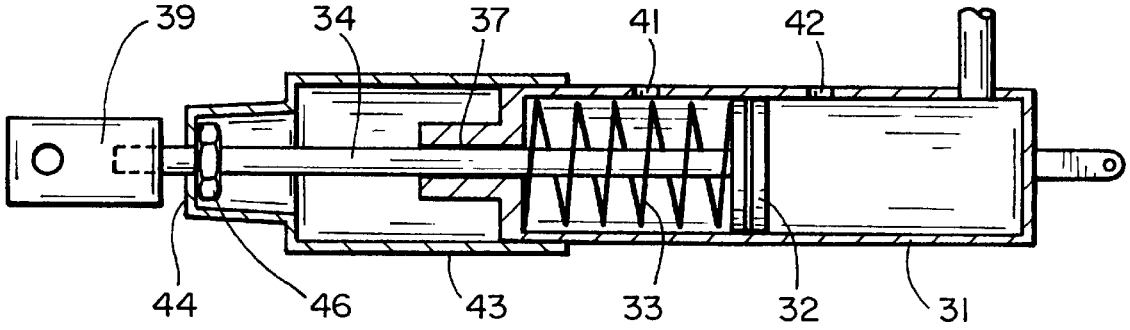
FIG. 4 shows the reject cylinder of FIG. 3 in the reject position.

A reject cylinder assembly incorporating the present invention is shown in detail in FIGS. 2, 3 and 4. The cylinder assembly includes cylinder 31 which receives a piston 32 which is driven to its retracted position by a spring 33. The piston includes the drive shaft 34 which passes through bearing 37. The end of the shaft threadibly receives the fitting 39, which engages the paddle 27, FIG. 1. Referring particularly to FIGS. 3 and 4, the cylinder 31 includes ports 41 and 42. The port 41 allows air to escape when the piston moves under the influence of the air pressure. The port 42 allows pressurized air to escape as soon as the piston passes to allow the piston to decelerate. A skirt 43 surrounds the end of the cylinder 31 and moves back and forth on the outside of the cylinder 31 as the shaft moves back and forth. The skirt includes a portion of reduced diameter 44 which engages the shaft and is held against the fitting 39 by the nut 46. The skirt covers and protects the shaft 34 and bearing 37 against juices, dirt and dust, thereby permitting prolonged operation of the reject mechanism without destruction of the bearing. This greatly reduces maintenance costs and down time. Thus there has been provided an improved sorting mechanism.

I claim:

1. In a color sorter of the type in which debris, unripe comestibles and ripe comestibles are sorted, an improved reject mechanism comprising:

a paddle for selectively striking one or more of said debris, unripe and ripe comestibles for sorting;

an elongated cylinder;

a piston, including a drive shaft extending from the cylinder through a bearing to engage and drive said paddle; and an elongated cylindrical skirt having a portion which slides along and covers the outside of said elongated cylinder and a portion of reduced diameter which engages said drive shaft whereby as said drive shaft moves back and forth the skirt moves with the shaft to continuously cover the outside of said elongated cylinder, shaft and bearing to thereby shield the shaft and bearing from the surrounds.

2. A color sorter as in claim 1 in which the comestibles are tomatoes.

* * * * *